US005878709A

United States Patent [19]

Andersson et al.

[11] Patent Number: 5,878,709

[45] Date of Patent: Mar. 9, 1999

[54] IGNITION SWITCH HAVING A POSITIVE OFF AND AUTOMATIC ON

[75] Inventors: Martin N. Andersson, Caro; Jason R. Koziatek, Bay City, both of Mich.

[73] Assignee: Walbro Corporation, Cass City, Mich.

[21] Appl. No.: 914,568

[22] Filed: Aug. 19, 1997

[51] Int. Cl.[6] ..... F02B 77/00

[52] U.S. Cl. ..... 123/198 DC

[58] Field of Search ..... 123/198 DC

[56] References Cited

U.S. PATENT DOCUMENTS

| | | | |
|---|---|---|---|
| 3,964,461 | 6/1976 | Wesemeyer et al. | 123/198 DC |
| 4,036,200 | 7/1977 | Kuehn, III | 123/198 DC |
| 4,073,279 | 2/1978 | Fox | 123/198 DC |
| 4,193,385 | 3/1980 | Katsumata et al. | 123/198 DC |
| 4,436,076 | 3/1984 | Piteo | 123/198 DC |
| 4,459,951 | 7/1984 | Tobinaga et al. | 123/198 DC |
| 4,951,625 | 8/1990 | Okuda | 123/198 DC |
| 4,976,234 | 12/1990 | Okuda | 123/198 DC |
| 5,190,019 | 3/1993 | Harvey | 123/198 DC |
| 5,646,461 | 7/1997 | Kubota | 123/198 DC |
| 5,730,098 | 3/1998 | Sasaki et al. | 123/198 DC |

*Primary Examiner*—David A. Okonsky

*Attorney, Agent, or Firm*—Barnes, Kisselle, Raisch, Choate, Whittemore & Hulbert, P.C.

[57] ABSTRACT

A positive off and automatic on ignition stop switch and electronic circuit for use in an internal combustion engine. The circuit that allows for normal operation of the engine in an unbiased state. When it is desired to turn the engine off, a stop switch is triggered which provides a single mechanism for shutting off the engine. After the switch is activated, the circuit holds the ignition circuit in an off state for a sufficient amount of time to allow the engine to completely stop operation. The circuit holds the engine in the off state for a period of time even after the switch is deactivated. As a result, the operator of a piece of equipment in which the present invention is utilized can activate a switch one time, which results in the engine coming to a complete stop, without the requirement of further activity.

6 Claims, 2 Drawing Sheets

IGNITION SWITCH HAVING A POSITIVE OFF AND AUTOMATIC ON

FIELD OF THE INVENTION

This invention relates to ignition switches generally, and more particularly, to an engine ignition switch incorporating a positive off and automatic on feature.

BACKGROUND OF THE INVENTION

On/off switches are typically used in small engines, such as gasoline engines incorporated in lawn and garden equipment, to provide a mechanism for turning off the engine. In such a system, the switch should be in an "on" position to start the engine. After the engine is running, the switch should be turned to the "off" position when it is desired to end the operation of the engine. While such a switch may provide for a simple operation of the engine, it has some undesirable qualities, such as relying on the operator to manually position the switch in the off and the on position. If the switch is left in the off position after the engine is turned off at the end of operation, the next time the engine is attempted to be started, the operator must turn the switch to the on position. If the operator inadvertently overlooks the necessity to turn the switch to the on position, an attempt to start the engine may flood the engine, which makes subsequent starting extremely difficult.

Another approach may be to provide a spring loaded switch that is biased to the on position. With such an approach, the operator would not have to remember to turn the switch to the on position for the next start of the engine. However, the operator must manually maintain the switch in the off position until the engine stops rotating. This is undesirable since an operator may hold the switch to the off position for a time less than adequate to completely shut off the engine and then release the switch so that the engine continues to operate, which may result in a dangerous condition.

SUMMARY OF THE INVENTION

This invention concerns an ignition positive off and automatic on stop switch, and circuit for use in an internal combustion engine. The present invention provides a circuit that allows for normal operation of the engine. When it is desired to turn the engine off, a stop switch is triggered, which provides a single mechanism for shutting off the engine. After the switch is activated, the circuit holds the engine in an off state for a sufficient amount of time to allow the engine to completely stop operation. The circuit holds the engine in the off state for a period of time even after the switch is deactivated. As a result, the operator of a piece of equipment in which the present invention is implemented can activate the switch one time, which results in the engine coming to a complete stop, without the requirement of further activity.

Objects, features and advantages of the present invention include providing a circuit that provides a positive off and automatic on feature for use in an internal combustion engine, allows a single activation of a switch to completely turn off the engine, provides an automatic on after the engine has completely stopped allowing the engine to restart on the next attempt, and provides a sufficient delay after activating of the switch to allow the engine to completely stop.

BRIEF DESCRIPTION OF THE DRAWINGS

These and other objects, features and advantages of this invention will be apparent from the following detailed description of the preferred embodiment(s) and best mode, appended claims and accompanying drawings in which:

DETAILED DESCRIPTION OF THE PREFERRED EMBODIMENT(S)

Figure 1:
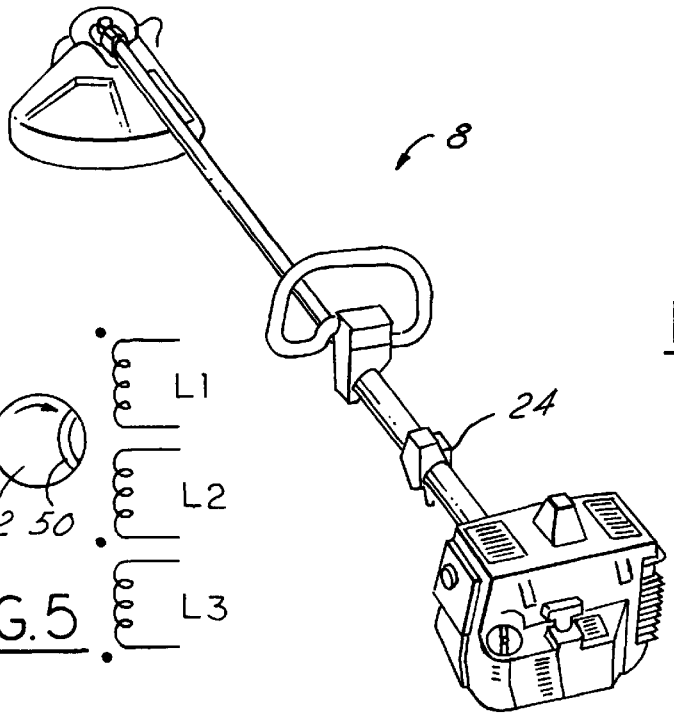
FIG. 1 is a perspective view of a lawn and garden machine implementing the present invention.

Referring to FIG. 1, a typical piece of lawn and garden equipment 8 is shown. The equipment 8 has a circuit 10 (FIG. 2) which operates in accordance with the preferred embodiment of the present invention. The circuit 10 contains a switch 24 that generally provides a switch signal to be used by the circuit 10 to disable the ignition system of the internal combustion engine of equipment 8. A single activation of the switch causes the circuit 10 to produce a cut off signal that disables the ignition system for a predetermined amount of time sufficient to allow the engine of the equipment 8 to come to a complete stop. After the engine comes to a complete stop, the circuit 10 deactivates the cut off signal allowing an automatic starting of the equipment on the next start attempt. Typically the circuit 10 is mounted within the engine fan housing.

Figure 5:
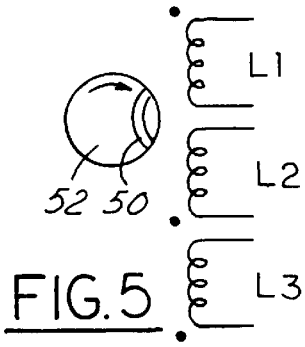
FIG. 5 is a schematic diagram of the engine flywheel and magnetic coil.
Figure 2:
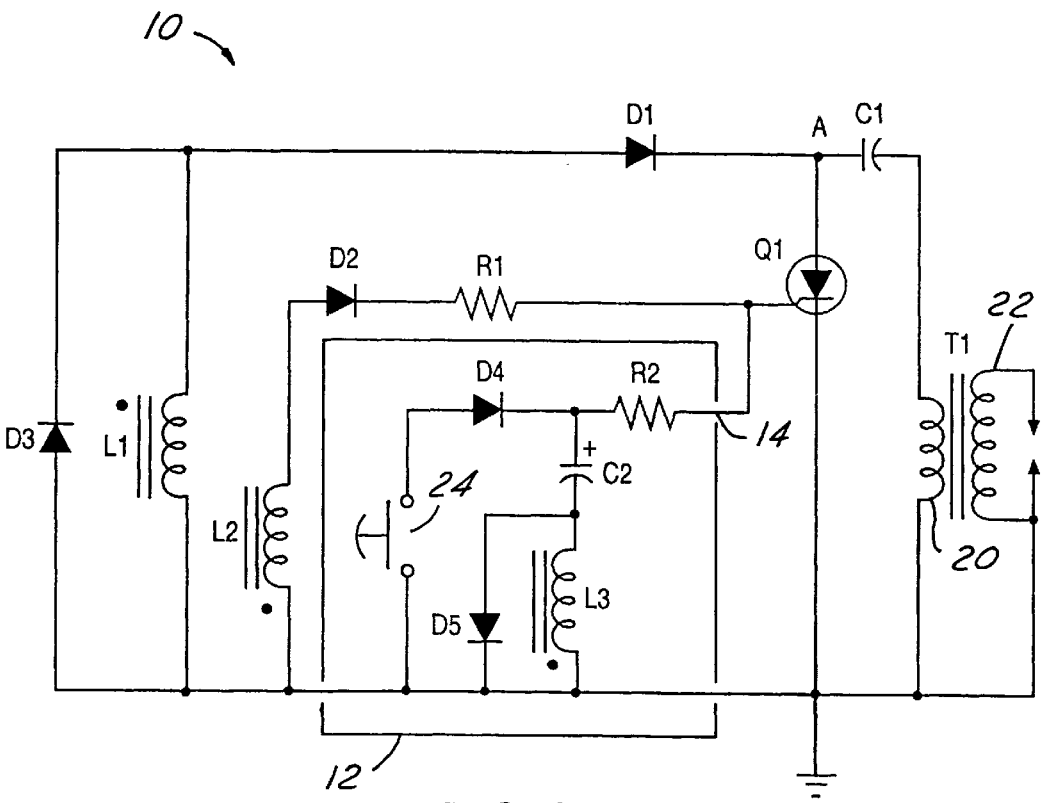
FIG. 2 is a circuit diagram of a preferred embodiment of the present invention implemented in an ignition system of an engine.

Referring to FIG. 2, an ignition circuit 10 is shown in accordance with the preferred embodiment of the present invention. The ignition circuit 10 generally comprises a positive off/automatic on circuit 12 implemented in an ignition circuit of an engine such as in the piece of equipment 8 of FIG. 1. The ignition circuit 10 generally comprises a charge coil L1, a trigger coil L2, a diode D1, a diode D2, a diode D3, a resistor R1, an SCR Q1, a capacitor Cl and a transformer T1. A node A is shown between the diode D1, the capacitor C1 and the SCR Q1. An anode of the SCR Q1 is generally coupled to the node A. A cathode of the SCR Q1 is generally coupled to ground. The gate of the SCR Q1 is generally coupled to a first side of the resistor R1 as well as to an output 14 of the circuit 12. The gate of the SCR Q1 receives the cut off signal from the circuit 12. A second side of the resistor R1 is coupled to a cathode side of the diode D2. An anode side of the diode D2 is generally coupled to a first side of the trigger coil L2. A second side of the trigger coil L2 is coupled to ground. The node A is also coupled to a first side of the capacitor C1. The node A generally receives an input supply voltage. A second side of the capacitor C1 is generally coupled to ground through a primary coil 20 of the transformer T1. An anode side of the diode D1 is coupled to the first side of the charge coil L1 as well as to the cathode side of the diode D3. A second side of the charge coil L1 is generally coupled ground. Similarly, the anode side of the diode D3 is coupled to ground. Coils L1, L2 are operatively coupled to a magnet 50 (FIG. 5) on the engine flywheel 52 for energizing the coils in the usual manner.

During normal operation, the circuit 10 operates in a similar fashion to a standard capacitor discharge ignition (CDI). Specifically, the charge coil L1 is responsive to rotation of flywheel magnet 50 to generate a voltage that is stored in the ignition capacitor C1. The ignition capacitor C1 is connected to the primary coil 20 of the transformer T1. The trigger coil L2 turns on the SCR Q1 by supplying a signal (i.e., a triggering voltage) to the gate of the SCR Q1 through the diode D2 and the resistor R1. The capacitor C1 then discharges through the SCR Q1 into the primary coil 20 of the transformer T1. As a result of this discharge, a high voltage on a secondary coil 22 of the transformer T1 is provided with sufficient amplitude to break the spark gap of a sparkplug in the combustion chamber (not shown) of the equipment 8 in which the circuit 10 is implemented. The diode D2 prevents any negative voltage from developing on the gate of the SCR Q1. The resistor R1 generally prevents the gate of the SCR Q1 from receiving an excessive amount of current. The diode D1 prevents the capacitor C1 from being discharged before the switch signal is asserted. As a result, when the switch 24 is in its normally open position, the ignition circuit 10 operates as a standard CDI ignition.

The circuit 12 generally comprises a resistor R2, a capacitor C2, a charge coil L3, a diode D4, a diode D5 and a switch 24. The output 14 is at a first side of the resistor R2. A second side of the resistor R2 is coupled to the cathode side of the diode D4 as well as to the positive side of the capacitor C2. The negative side of the capacitor C2 is coupled to the first side of the charge coil L3 as well as to the anode side of the diode D5. A second side of the charge coil L3 as well as a cathode side of the diode D5 are coupled to ground. An anode side of the diode D4 is connected to a first side of the switch 24. A second side of the switch 24 is generally coupled to ground. The switch is yieldably biased to a normally "off" or open non-conducting position, and when its actuator button is depressed or activated it closes or is in an "on" or conducting position until its actuator button is released, whereupon it returns to its off or open non-conducting position.

When switch 24 is closed, a conductive path is established from coil L3 through switch 24 and diode D4 to charge capacitor C2. Energy pulses of one polarity generated in coil L3 by passage of magnet 50 (FIG. 5) are thus stored in capacitor C2, while energy pulses of the opposite polarity in coil L3 are shunted by diode D5. Energy stored on capacitor C2 discharges through the resistor R2 creating the shut off signal at the gate of the SCR Q1. As a result, the SCR Q1 is turned "on". When the SCR Q1 is held on, the charging of the ignition capacitor C1 is generally prevented since a current path is created from the anode to ground. As a result, the ignition circuit 10 is effectively disabled. After the switch 24 is deasserted, the capacitor C2 retains an amount of energy sufficient to continue to hold the SCR Q1 "on" for a length of time sufficient to allow the engine to come to a complete stop. The values of the capacitor C2 and the resistor R2 are selected such that the cut off signal is asserted for a length of time necessary to allow a particular engine to stop. As such, the values of the capacitor C2 and the resistor R2 may be adjusted to provide the necessary "on" time of the SCR Q1 for a particular engine application to insure it comes to a complete stop before the SCR Q1 is turned "off". The diode D5 is a component that helps prevent the coil L3 from turning on the SCR Q1 during normal operation when the stop switch 24 is normally deasserted. The diode D4 prevents capacitor C2 from discharging too quickly if switch 24 is left in the on position.

Figure 3:
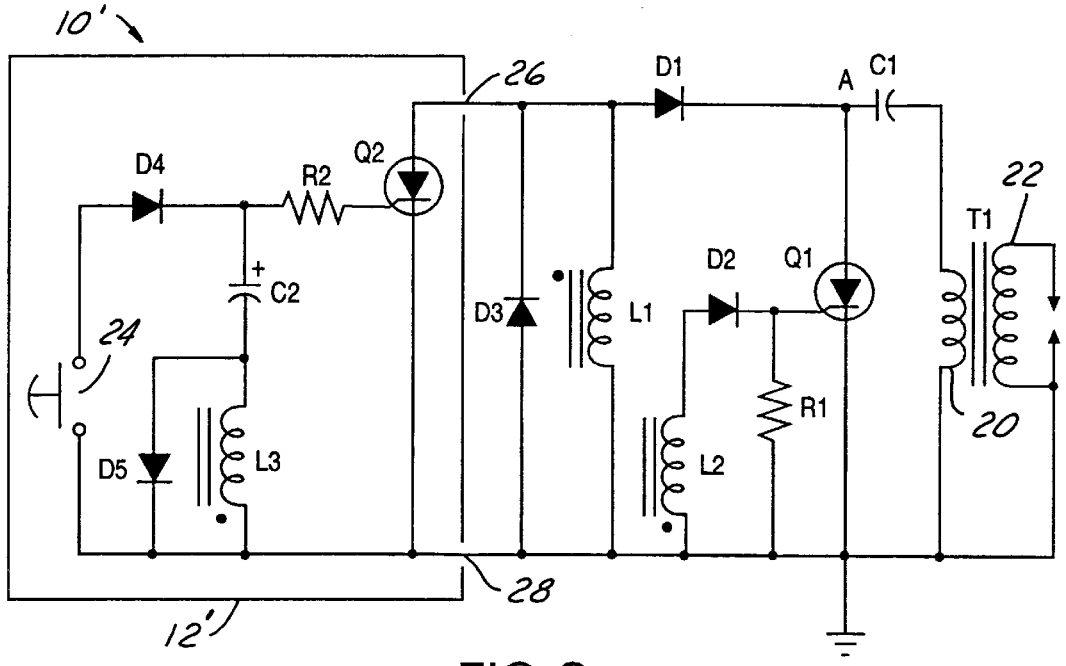
FIG. 3 is an alternate embodiment of the present invention implemented in an ignition system of an engine.

Referring to FIG. 3, an alternate embodiment of a circuit 10' is shown. The diode D1, the diode D3, the charge coil L1, the capacitor C1 and the transformer T1 are as shown configured in a similar fashion to the embodiment shown in FIG. 2. However, the trigger coil L2, the diode D2 and the resistor R1 are as shown in an alternate configuration. The diode D2 and the trigger coil L2 form a first parallel path from the gate of the SCR Q1 to ground. The resistor R1 provides a second parallel path between the gate of the SCR Q1 and ground.

The circuit 12' as shown has an input 26 and a ground connection 28. The stop switch 24, the diode D4, the diode D5, the resistor R2, the capacitor C2 and the charge coil L3 are configured in a similar fashion to the embodiment described in connection with FIG. 2. An additional SCR Q2 is provided between the input 26 and the ground 28. An anode of the SCR Q2 receives a signal from the input 26. The cathode of the SCR Q2 is connected to ground 28. The gate of the SCR Q2 receives the switch signal through the resistor R2. The circuit 10' generally requires the implementation of an additional SCR Q2. The SCR Q2 operates independently from the SCR Q1. The SCR Q1 generally provides the main ignition for the engine. The SCR Q2 directly shorts out the charge coil L1 to produce the cut off signal and therefore prevents the ignition capacitor C1 from being charged. While the alternate implementation of circuit 10' requires an additional SCR Q2, it may allow for more effective control of the circuit 10'. The SCR Q2 is generally limited to the finction of providing the cut off signal and may be isolated from the ignition event. As a result, a non-sensitive high-current SCR Q1 may be used as the main ignition SCR while the SCR Q2 can perform the stop finction by generating the cut off signal. The SCR Q2 can be designed having a sensitive gate and may be implemented as a lower current SCR.

Figure 4:
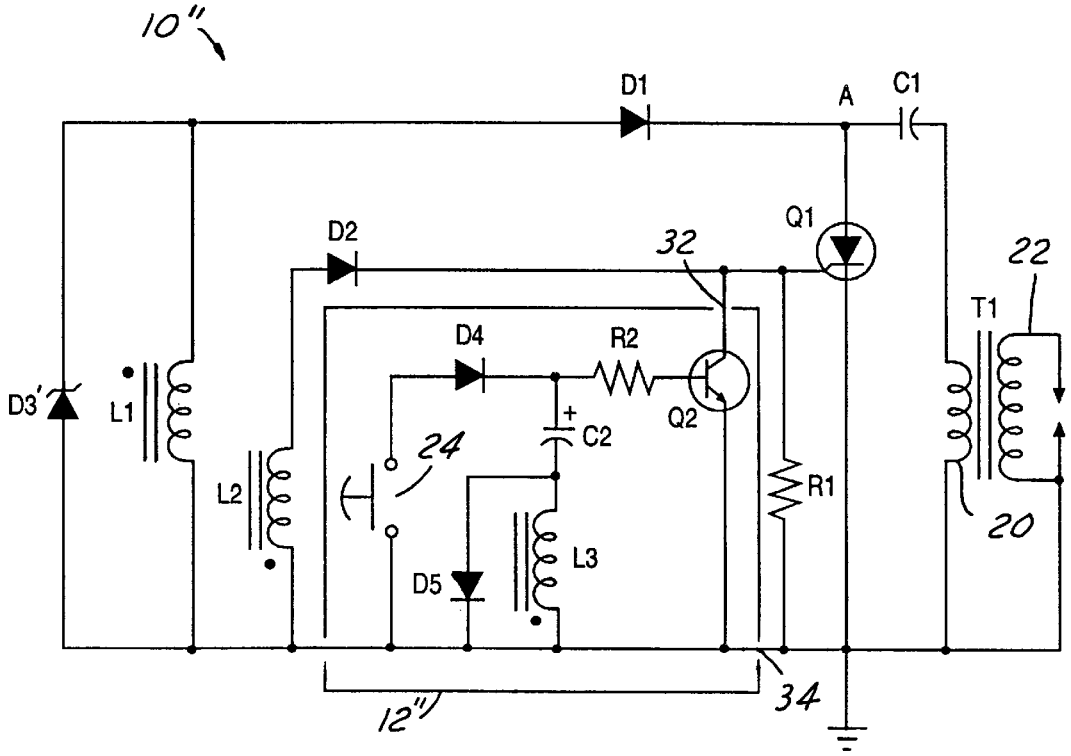
FIG. 4 is a second alternate embodiment of the present invention implemented in an ignition system of an engine.

Referring to FIG. 4, a second alternate circuit 10" is shown. The diode D3', the charge coil L1, the trigger coil L2, the diode D1, the diode D2, the resistor R1, the SCR Q1, the capacitor C1 and the transformer T1 are shown configured in a similar fashion to the embodiment shown in FIG. 3. The stop switch 24, the diode D4, the diode D5, the charge coil L3, the capacitor C2 and the resistor R2 are also configured in a similar fashion to the embodiment described in connection with FIG. 3. The circuit 12"generally comprises an input 32 and a ground connection 34. The input 32 is generally coupled between the diode D2 and the SCR Q1 and generally presents the cut off signal to the collector of the transistor Q2. The emitter of the transistor Q2 is generally coupled to ground. The base of the transistor Q2 is generally coupled to the resistor R2. The circuit 12" is generally coupled in parallel with the gate of the SCR Q1.

The alternate circuit 10" allows the SCR Q1 to be disabled in response to the switch present at the gate. As a result, the capacitor C1 is not allowed to discharge through the primary coil 20 of the transformer T1. While the alternate embodiment 10" does require the additional transistor Q2 (similar to FIG. 3), it does allow use of an inexpensive low voltage and low current transistor Q2. Additionally, the diode D3' prevents the overcharging of the capacitor C1. The diode D3' is a zener diode to limit the charge stored on capacitor C1 with SCR Q1 disabled.

The transistor Q2 may be implemented as an SCR or any other transistor necessary to meet the design criteria of a particular application. The diodes D1, D2, D3, D4 and D5 may be implemented as transistors configured as diodes.

While the invention has been particularly shown and described with reference to the presently preferred embodiments thereof, it will be understood by those skilled in the art that various changes in form and details may be made without departing from the spirit and scope of the invention.

There have thus been disclosed three embodiments of the invention responsive to closure of a shut-off switch 24 for disabling operation of the engine ignition. In each embodiment, the closure of the shut-off switch 24 places charge on a capacitor C2 from an energy source L3 through a diode D4, which prevents discharge of the capacitor through the switch. The capacitor C2 then discharges through a resistor R2 into an electronic switch Q1 (FIG. 1) or Q2 (FIGS. 2 and 3) for disabling the ignition. In FIGS. 1 and 2, ignition is disabled by preventing charging of capacitor C1, while in FIG. 4 ignition is disabled by preventing discharge of capacitor C1 through SCR Q1. The energy source L3 in all three embodiments comprises a coil responsive to passage of flywheel magnet 50.

We claim:

1. A capacitor discharge engine ignition system that comprises:

an ignition charge storage capacitor, an ignition coil for transferring energy to an engine spark plug, first electronic switch means having a control electrode and primary current conducting electrodes responsive to said control electrode for transferring charge from said ignition charge storage capacitor to said ignitor coil, a flywheel magneto including a magnet on an engine flywheel, charge coil means connected to said ignition charge storage capacitor for periodically storing charge on said capacitor responsive to engine rotation of the flywheel and passage of the magnet, and trigger coil means connected to said control electrode and responsive to passage of said magnet for periodically operating said first electronic switch means to transfer charge stored from said charge coil means on said ignition charge storage capacitor to said ignition coil, and apparatus for selectively preventing transfer of charge from said charge coil means to said ignitor charge storage capacitor, and thereby terminating operation of the engine, comprising:

second electronic switch means having a control electrode, and primary current conducting electrodes connected across said ignition charge storage capacitor and said ignition coil, third coil means responsive to passage of said magneto magnet, a second capacitor connected in series with said third coil means, and a manual switch connected across said third coil means and said second capacitor, and responsive to an operator for charging said second capacitor from said third coil means response to passage of the flywheel magnet past said third coil means, and means including a discharge control resistor connected between said second capacitor and said control electrode of said second electronic switch means for controlling discharge of said second capacitor into said second electronic switch means, and thereby interconnecting said primary electrodes of said second electronic switch means to inhibit accumulation of charge on said ignition charge storage capacitor, for a time duration determined by discharge of said second capacitor through said resistor.

2. The system as set forth in claim 1 wherein said first and second electronic switch means comprises differing electronic switch means.

3. The system as set forth in claim 1 wherein said first and second electronic switch means comprise the same electronic switch means, said trigger coil means and said apparatus being connected in parallel to said control electrode.

4. The system as set forth in claim 1 further comprising a diode connected in series with said manual switch to prevent discharge of said second capacitor through said manual switch.

5. The system as set forth in claim 4 further comprising a second diode connected across said third coil means to shunt reverse current generated in said third coil means.

6. The system as set forth in claim 5 wherein said trigger coil means and said third coil means are identically polarized with respect to said magnet and said flywheel.

* * * * *